US006280179B1

(12) United States Patent
Bird

(10) Patent No.: US 6,280,179 B1
(45) Date of Patent: Aug. 28, 2001

(54) OVER TEMPERATURE LIMITING SCHEME BY REDUCING GAS PRESSURE

(75) Inventor: Douglas D. Bird, Little Canada, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/450,079

(22) Filed: Nov. 29, 1999

(51) Int. Cl.[7] ..... F23N 5/00

(52) U.S. Cl. ..... 431/12; 431/75; 431/89; 251/205; 126/39 BA

(58) Field of Search ..... 431/75, 12, 355, 431/18, 20, 78, 79, 80, 89; 126/110 R, 110 A, 39 R, 39 E, 110 C; 251/205, 329, 332

(56) References Cited

U.S. PATENT DOCUMENTS

| | | | | |
|---|---|---|---|---|
| 4,852,797 | | 8/1989 | Goerlich . | |
| 5,020,771 | | 6/1991 | Nakatsukasa et al. . | |
| 5,234,196 | * | 8/1993 | Harris | 431/355 |
| 5,238,398 | * | 8/1993 | Harris | 431/355 |
| 5,662,465 | * | 9/1997 | Kano | 431/75 |
| 5,667,375 | * | 9/1997 | Sebastiani | 431/75 |
| 5,865,618 | * | 2/1999 | Hiebert | 126/110 A |

FOREIGN PATENT DOCUMENTS

| | | |
|---|---|---|
| 19645179.5 | 5/1998 | (DE) . |

* cited by examiner

*Primary Examiner*—James C. Yeung

(57) ABSTRACT

An apparatus for and method for protecting the electronic circuitry within a gas appliance. The electronic circuitry is arranged on a circuit board. A temperature sensor, located on the circuit board is periodically read to determine the current temperature. If the current temperature exceeds a first predetermined value, a microprocessor commands a stepper motor to reduce the input fuel pressure to the main burner. If the current temperature is within an acceptable range, the microprocessor permits the user to increase main valve outlet pressure.

20 Claims, 5 Drawing Sheets

OVER TEMPERATURE LIMITING SCHEME BY REDUCING GAS PRESSURE

CROSS REFERENCE TO CO-PENDING APPLICATIONS

U.S. patent application Ser. No. 09/447,611, filed Nov. 23, 1999, and entitled, "LOW INPUT VOLTAGE, LOW COST, MICRO-POWER DC-DC CONVERTER"; U.S. patent application Ser. No. 09/447,999, filed Nov. 23, 1999, and entitled, "STEPPER MOTOR DRIVING A LINEAR ACTUATOR OPERATING A PRESSURE CONTROL REGULATOR"; U.S. patent application Ser. No. 09/447,612, filed Nov. 23, 1999, and entitled, "LOW INPUT VOLTAGE, HIGH EFFICIENCY, DUAL OUTPUT DC TO DC CONVERTER"; U.S. patent application Ser. No. 09/450,077, filed Nov. 29, 1999, and entitled, "ELECTRONIC FUEL CONVERTIBILITY SELECTION"; and U.S. patent application Ser. No. 09/448,000, filed Nov. 23, 1999, and entitled, "ELECTRONIC DETECTING OF FLAME LOSS BY SENSING POWER OUTPUT FROM THERMOPILE" are commonly assigned co-pending applications incorporated herein by reference.

BACKGROUND OF THE INVENTION

1. Field of the Invention

The present invention generally relates to systems for control of a gas appliance incorporating a flame and more particularly relates to fuel control valve systems.

2. Description of the Prior Art

It is known in the art to employ various appliances for household and industrial applications which utilize a fuel such as natural gas (i.e., methane), propane, or similar gaseous hydrocarbons. Typically, such appliances have the primary heat supplied by a main burner with a substantial pressurized gas input regulated via a main valve. Ordinarily, the main burner consumes so much fuel and generates so much heat that the main burner is ignited only as necessary. At other times (e.g., the appliance is not used, etc.), the main valve is closed extinguishing the main burner flame.

A customary approach to reigniting the main burner whenever needed is through the use of a pilot light. The pilot light is a second, much smaller burner, having a small pressurized gas input regulated via a pilot valve. In most installations, the pilot light is intended to burn perpetually. Thus, turning the main valve on provides fuel to the main burner which is quickly ignited by the pilot light flame. Turning the main valve off, extinguishes the main burner, which can readily be reignited by the presence of the pilot light.

These fuels, being toxic and highly flammable, are particularly dangerous in a gaseous state if released into the ambient. Therefore, it is customary to provide certain safety features for ensuring that the pilot valve and main valve are never open when a flame is not present preventing release of the fuel into the atmosphere. A standard approach uses a thermogenerative electrical device (e.g., thermocouple, thermopile, etc.) in close proximity to the properly operating flame. Whenever the corresponding flame is present, the thermocouple generates a current. A solenoid operated portion of the pilot valve and the main valve require the presence of a current from the thermocouple to maintain the corresponding valve in the open position. Therefore, if no flame is present and the thermocouple(s) is cold and not generating current, neither the pilot valve nor the main valve will release any fuel.

In practice, the pilot light is ignited infrequently such as at installation, loss of fuel supply, etc. Ignition is accomplished by manually overriding the safety feature and holding the pilot valve open while the pilot light is lit using a match or piezo igniter. The manual override is held until the heat from the pilot flame is sufficient to cause the thermocouple to generate enough current to hold the safety solenoid. The pilot valve remains open as long as the thermocouple continues to generate sufficient current to actuate the pilot valve solenoid.

The safety thermocouple(s) can be replaced with a thermopile(s) for generation of additional electrical current. This additional current may be desired for operating various indicators or for powering interfaces to equipment external to the appliance. Normally, this requires conversion of the electrical energy produced by the thermopile to a voltage useful to these additional loads. Though not suitable for this application, U.S. Pat. No. 5,822,200, issued to Stasz; U.S. Pat. No. 5,804,950, issued to Hwang et al.; U.S. Pat. No. 5,381,298, issued to Shaw et al.; U.S. Pat. No. 4,014,165, issued to Barton; and U.S. Pat. No. 3,992,585, issued to Turner et al. all discuss some form of voltage conversion.

Upon loss of flame (e.g., from loss of fuel pressure), the thermocouple(s) ceases generating electrical current and the pilot valve and main valve are closed, of course, in keeping with normal safety requirements. Yet this function involves only a binary result (i.e., valve completely on or valve completely off). Though it is common within vehicles, such as automobiles, to provide variable fuel valve control as discussed in U.S. Pat. No. 5,546,908, issued to Stokes, and U.S. Pat. No. 5,311,849, issued to Lambert et al., it is normal to provide static gas appliances with a simple on or off, linearly actuated valve having the desired safety features.

Yet, there are occasions when it is desirable to adjust the outlet pressure regulation point of the main burner supply valve of a standard gas appliance. These include changes in mode (i.e., changes in the desired intensity of the flame) and changes in the fuel type (e.g., a change from propane to methane). U.S. Pat. No. 5,234,196, issued to Harris; U.S. Pat. No. 4,816,987, issued to Brooks et al.; U.S. Pat. No. 5,873,351, issued to Vars et al.; and U.S. Pat. No. 5,150,685, issued to Porter et al., suggest approaches to variable valve positioning of a gas appliance. However, the introduction of an entirely new valve design is likely to introduce severe regulatory difficulties. The present safety valve approach has been used for such a long time with satisfactory results. Proof of safe operation of a new approach to valve design would require substantial costly end user testing.

One of the problems associated with the use of a gas appliance, such as a gas fireplace, is temperature regulation. It is customary to provide a main burner, main valve, and fuel pressure regulator combination which can produce a desired combustion chamber temperature and output heat transfer. However, with fixed fuel supply systems, certain details of usage can have a major impact on combustion chamber temperature. For example, a user may choose to close glass combustion chamber doors, even when advised against such action, producing highly elevated combustion chamber temperatures. Similarly, variable output circulation fans may cause similarly large temperature variations.

As electronic components are added to the gas appliance, such temperature variations can cause damage. Though undesirable, the gas appliance could be sized such that the combustion chamber would never exceed a maximum temperature. At least equally undesirable especially from a cost perspective, special electronic components could be developed to operate at abnormally high ambient temperatures. Also costly, particularly at installation, the electronic components could be mounted remotely from the combustion chamber.

SUMMARY OF THE INVENTION

The present invention overcomes the disadvantages of the prior art by providing a main burner valve for a gas appliance having variable outlet pressure. The main burner valve of the present invention utilizes a standard, linearly actuated valve design having proven safety features, but which also offers precisely controllable fuel input. A temperature sensor on the electronic circuit board enables control of the main valve to prevent overheating of the electronic circuitry.

In accordance with the preferred mode of the present invention, a thermopile is thermally coupled to the pilot flame. As current is generated by the thermopile, it is converted via a DC-to-DC converter to a regulated output and an unregulated output. The regulated output powers a microprocessor and other electronic circuitry which control operation of the main fuel valve in response to sensed temperature conditions. The unregulated output powers various mechanical components including a stepper motor.

The stepper motor is mechanically coupled to a linear actuator which precisely positions the main fuel valve. Because the main fuel valve is linearly actuated, it operates in known fashion with respect to the industry proven flame out safety features. Yet, the stepper motor, under direct control of the microprocessor, positions the linear actuator for precise valve positioning and therefore, fuel input modulation to the main burner.

The use of a stepper motor means that any selected valve position is held statically by the internal rachet action of the stepper motor without quiescent consumption of any electrical energy. That rhakes the electrical duty cycle of the stepper motor/valve positioning system extremely low. This is a very important feature which permits the system to operate under the power of the thermopile without any necessary external electrical power source. In fact, the stepper motor duty cycle is sufficiently low, that the power supply can charge a capacitor slowly over time such that when needed, that capacitor can power the stepper motor to change the position of the linear actuator and hence the outlet pressure regulation point of the main fuel valve.

In accordance with the present invention, the output of the temperature sensor on the electronic circuit board is determined periodically. If the sensed temperature is greater than a desired level (e.g., 185 degrees f.), the microprocessor instructs the stepper motor to reduce the main valve pressure to reduce operating temperature. If the sensed temperature is within acceptable limits of the control, the microprocessor instructs the stepper motor to increase the main valve pressure, if requested by the user.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
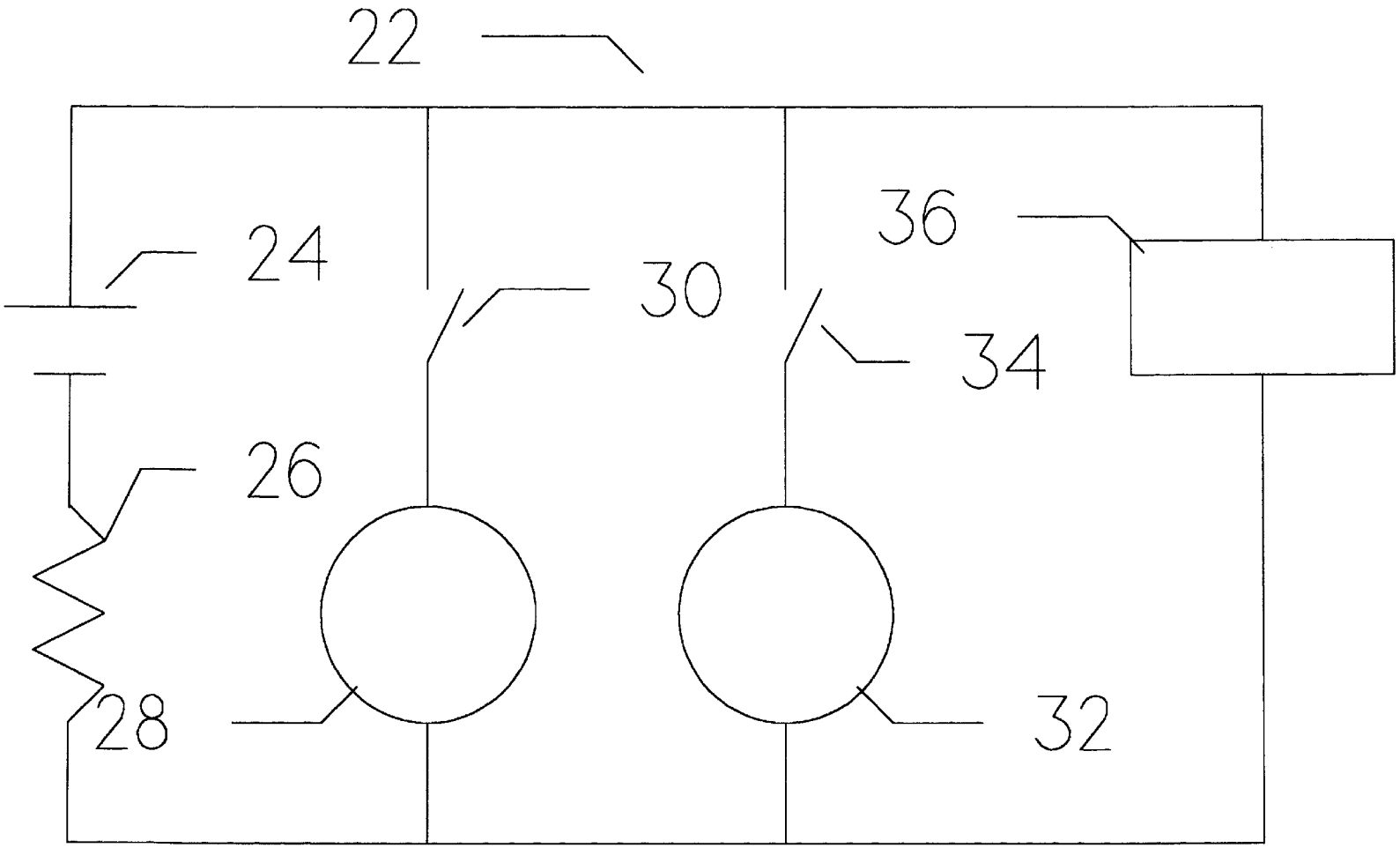
FIG. 1 is a simplified electrical schematic diagram of the present invention.

FIG. 1 is a very basic electrical diagram 22 of the power circuitry of the present invention. Thermopile 24 is structured in accordance with the prior art. Resistor 26 represents the internal resistance of thermopile 24.

Pilot valve 28 has a solenoid (not separately shown) which holds the pilot valve closed whenever sufficient current flows through the circuit. Similarly, the internal solenoid (also not separately shown) of main valve 32 holds the main valve closed whenever sufficient current flows through the associated circuit.

DC-to-DC conversion facility 36 converts the relatively low voltage output of thermopile 24 to a sufficiently large voltage to power the electronic control circuitry, including the microprocessor. In accordance with the preferred mode of the present invention, DC-to-DC conversion facility 36 consists of two DC-to-DC converters. The first converter operates at the extremely low thermopile output voltages experienced during combustion chamber warm up to generate a higher voltage to start the higher efficiency, second DC-to-DC converter. The other DC-to-DC converter, once started, can keep converting at much lower input voltage and generate much more power from the limited thermopile output for the system during normal operation. A more detailed description of these devices is available in the above identified and incorporated, commonly assigned, co-pending U.S. Patent Applications.

Figure 2:
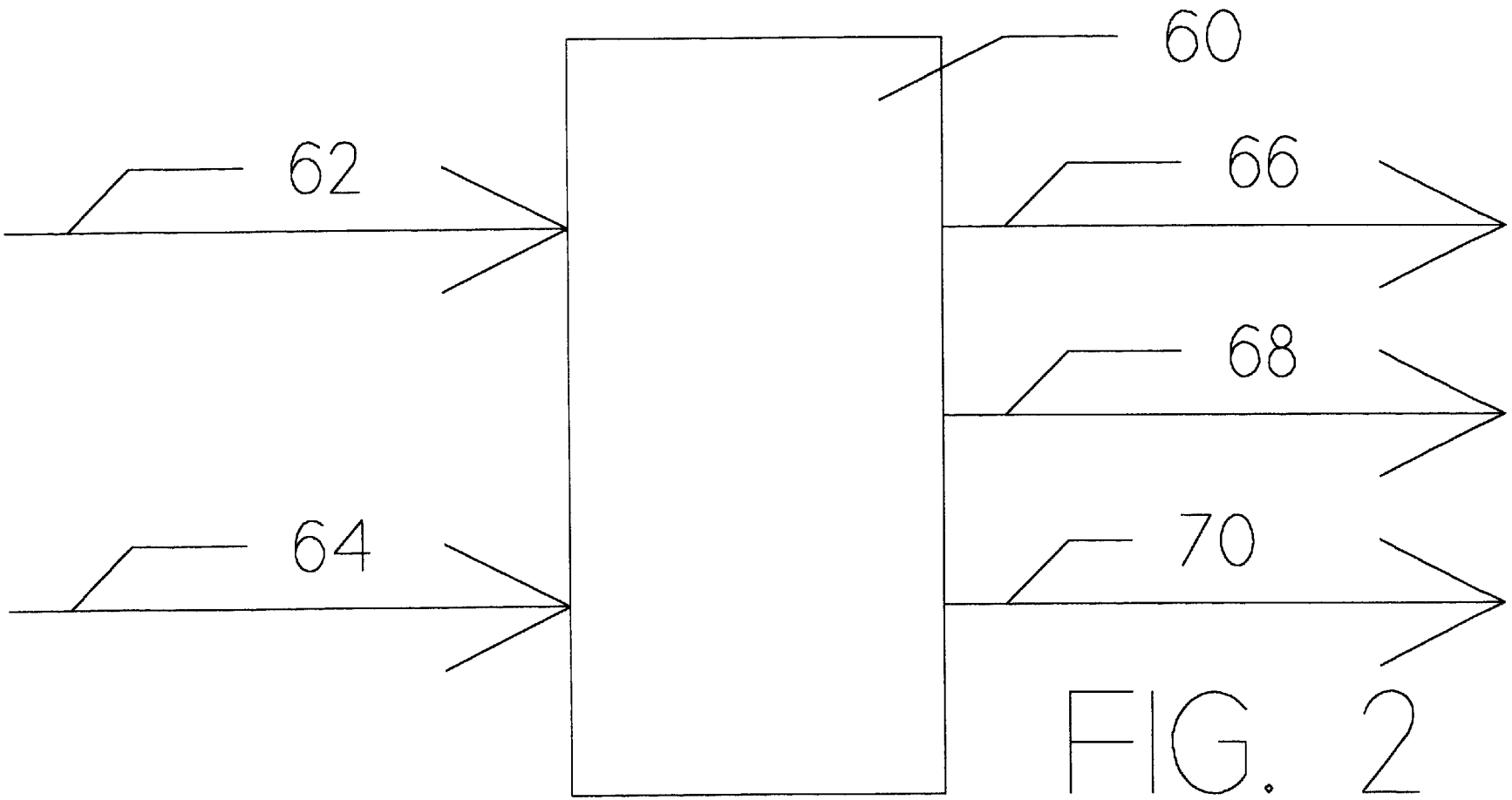
FIG. 2 is a simplified block diagram of the microprocessor of the present invention.

FIG. 2 is a simplified diagram showing the basic inputs and outputs of microprocessor 60. In the preferred mode, microprocessor 60 is an 8-bit AVR model AT90LS8535 microprocessor available from ATMEL. It is a high performance, low power, restricted instruction set (i.e., RISC) microprocessor. In the preferred mode, microprocessor 60 is clocked at one megahertz to save power, even though the selected device may be clocked at up to four megahertz.

To practice the present invention, the two primary inputs to microprocessor 60 are the thermopile output voltage, received via input 62, and the temperature sensor output, received via input 64. The thermopile output voltage and temperature sensor output are received once per second.

Output 66 controls operation of the stepper motor. As is explained in more detail below, this affects management of the main fuel valve pressure. Output 68 is the on/off control for the external circulation fan. Output 70 controls the radio frequency receiver through which an operator can communicate via a remote control device.

Figure 3:
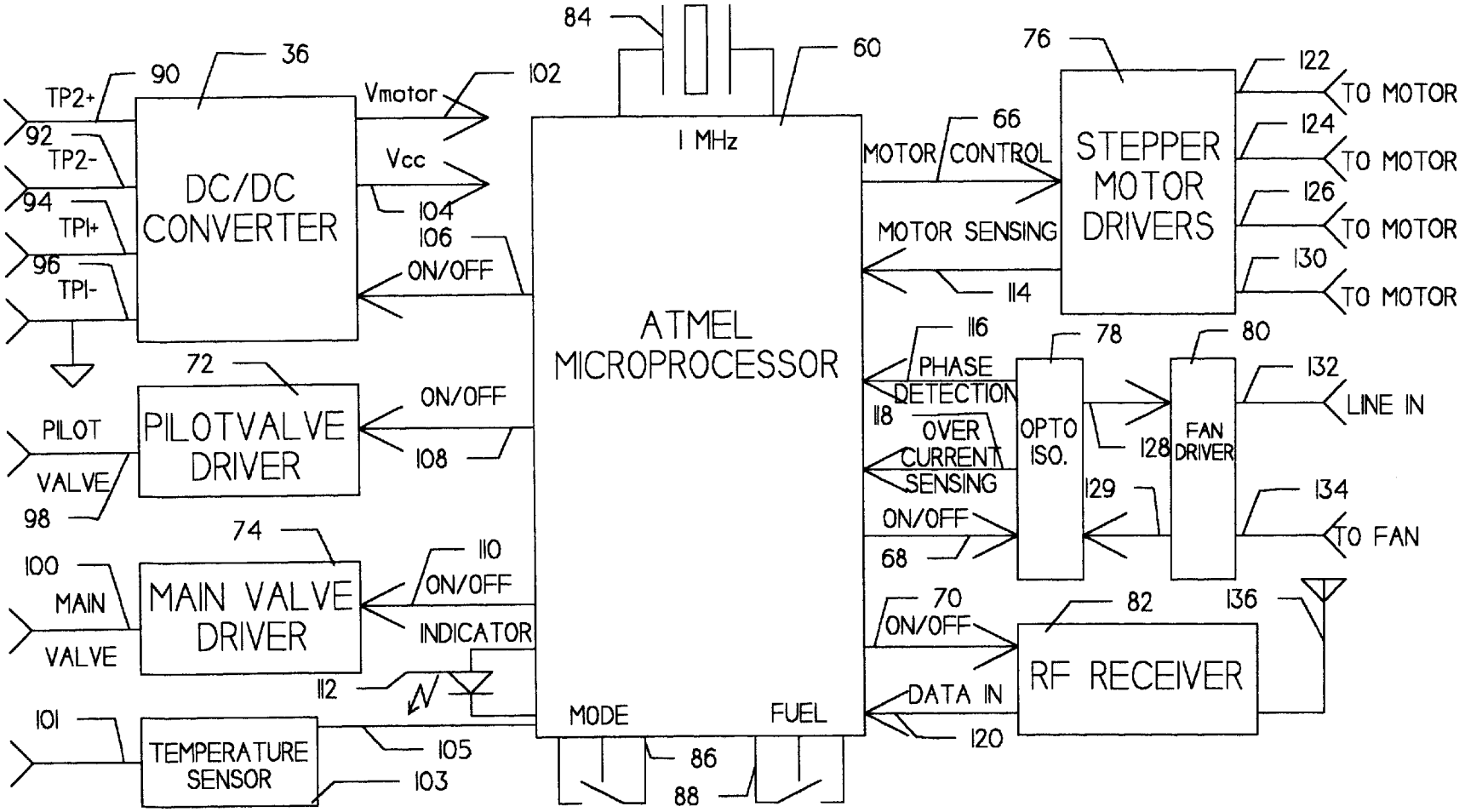
FIG. 3 is a detailed electrical block diagram.

FIG. 3 is a detailed block diagram of the inputs and outputs of microprocessor 60. One megahertz crystal 84 clocks microprocessor 60. The output of crystal 84 is also divided down to provide an interrupt to microprocessor 60 once per second. This interval is utilized for sampling of the thermopile output voltage and temperature sensor output. Indicator 112 permits early notification of flame on to the user.

Manual mode switch 86 permits an operator to select local mode or remote mode. Similarly, manual switch 88 is used to select the input fuel type, so that the main valve outlet pressure can be switched between propane and methane. Each of these alternative switch positions cause microprocessor 60 to consult a particular corresponding entry within the valve positioning table stored in the non-volatile memory of microprocessor 60. These entries provide the necessary information for microprocessor to direct the stepper motor to set the main burner valve outlet pressure to the proper level. The method for determining the valve positioning table entries is described in detail in the above referenced co-pending patent application.

DC-to-DC converter 36 can receiver inputs from up to two thermopiles. Inputs 94 and 96 provide the positive and negative inputs from the first thermopile, whereas inputs 90 and 92 provide the positive and negative inputs from the second thermopile, respectively. Output 102 is the unregulated output of DC-to-DC converter 36. This output has a voltage varying between about 6 volts and 10 volts. The unregulated output powers the mechanical components, including the stepper motor. Line 104 is a 3 volt regulated output. It powers microprocessor 60 and the most critical electronic components. Line 106 permits microprocessor to power DC-to-DC converter 36 up and down. This is consistent with the voltage sampling and analysis by microprocessor 60 which predicts flame out conditions.

Line 72 enables and disables pilot valve driver 72 coupled to the pilot valve via line 98. Similarly, line 110 controls main valve driver 74 coupled to the main valve via line 100. This is important because microprocessor 60 can predict flame out conditions and shut down the pilot and main valves long before the output of the thermopile is insufficient to hold the valves open. A more detailed description of this significant feature may be found in the above referenced, co-pending, commonly assigned, and incorporated U.S. Patent Applications.

Temperature sensor 103 is a standard device known in the art. It is physically mounted on the electronic circuit board, as the temperature control is primarily to ensure that the electronic components are not overheated. The output of temperature sensor 103 is provided on line 105.

Stepper motor drivers 76 are semiconductor switches which permit the output of discrete signals from microprocessor 60 to control the relatively heavy current required to drive the stepper motor. In that way, line 66 controls the stepper motor positioning in accordance with the direction of the microprocessor firmware. Line 114 permits sensing of the stepper motor status. Lines 122, 124, 126, and 130 provide the actual stepper motor current.

In the preferred mode of practicing the present invention, the gas appliance is a fireplace. The thermopile output is not sufficient to power the desired fan. However, the system can control operation of the fan. Therefore, line 132 provides the external power which is controlled by fan driver 80. Lines 128 and 129 couple to optical isolation device 78 for coupling via lines 68, 116, and 118 to microprocessor 60. Line 134 actually powers the fan.

The fireplace of the preferred mode also has radio frequency remote control. A battery operated transmitter communicates with rf receiver 82 via antenna 136. Lines 70 and 120 provide the interface to microprocessor 60. Rf receiver 82 is powered by the 3 volt regulated output of DC-to-DC converter 36 found on line 104.

Figure 4:
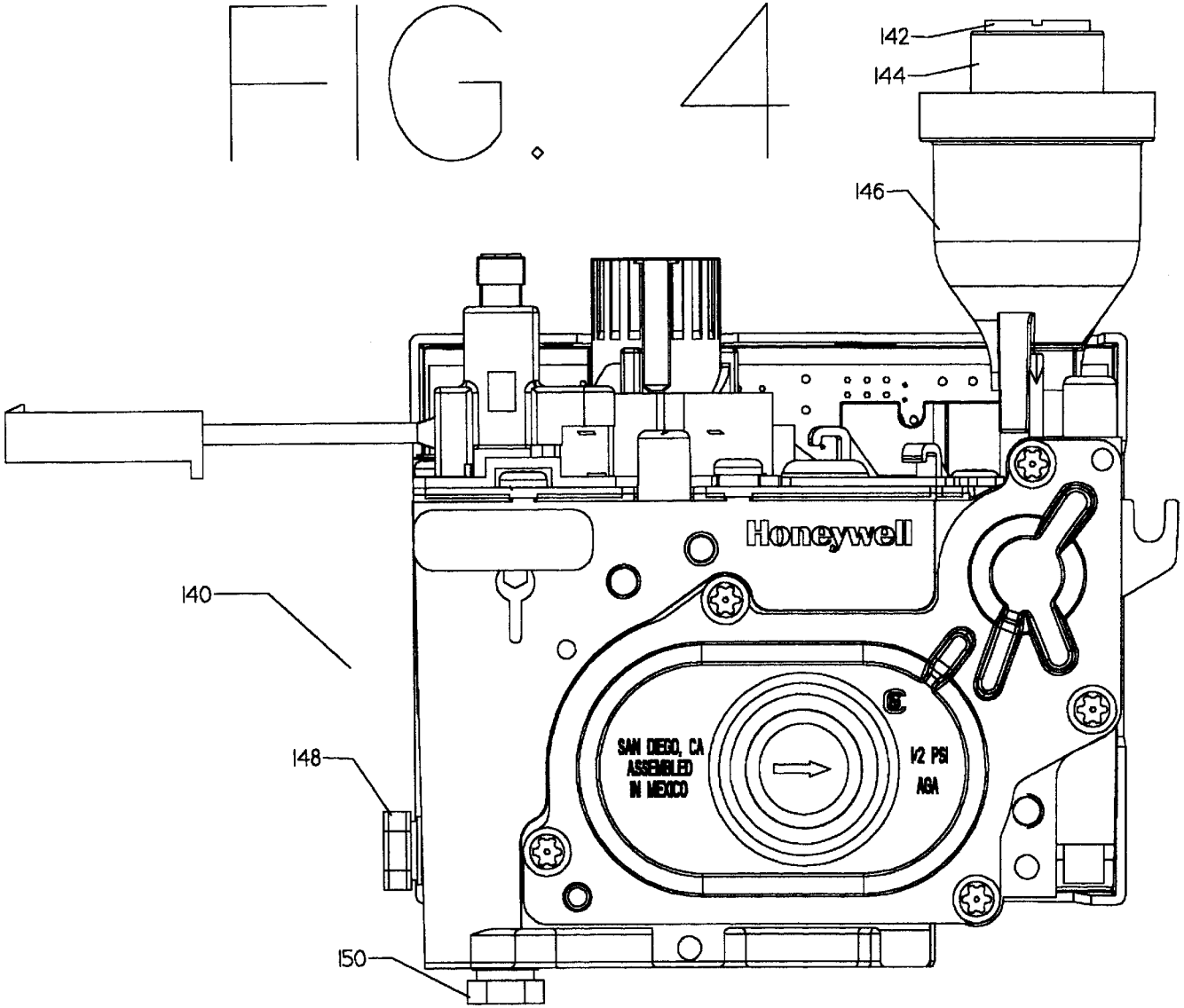
FIG. 4 is a plan view of the valve assembly.

FIG. 4 is a plan view of the valve assembly 140 of the preferred mode of the present invention. Fuel inlet 150 has standard fittings. Similarly, gas outlet 148 includes a standard coupling. Regulator cap 142 fits within housing cap 144 as shown (a better view is found in the section of FIG. 5). Motor housing 146 contains the linear actuator and stepper motor (neither shown in this view).

Figure 5:
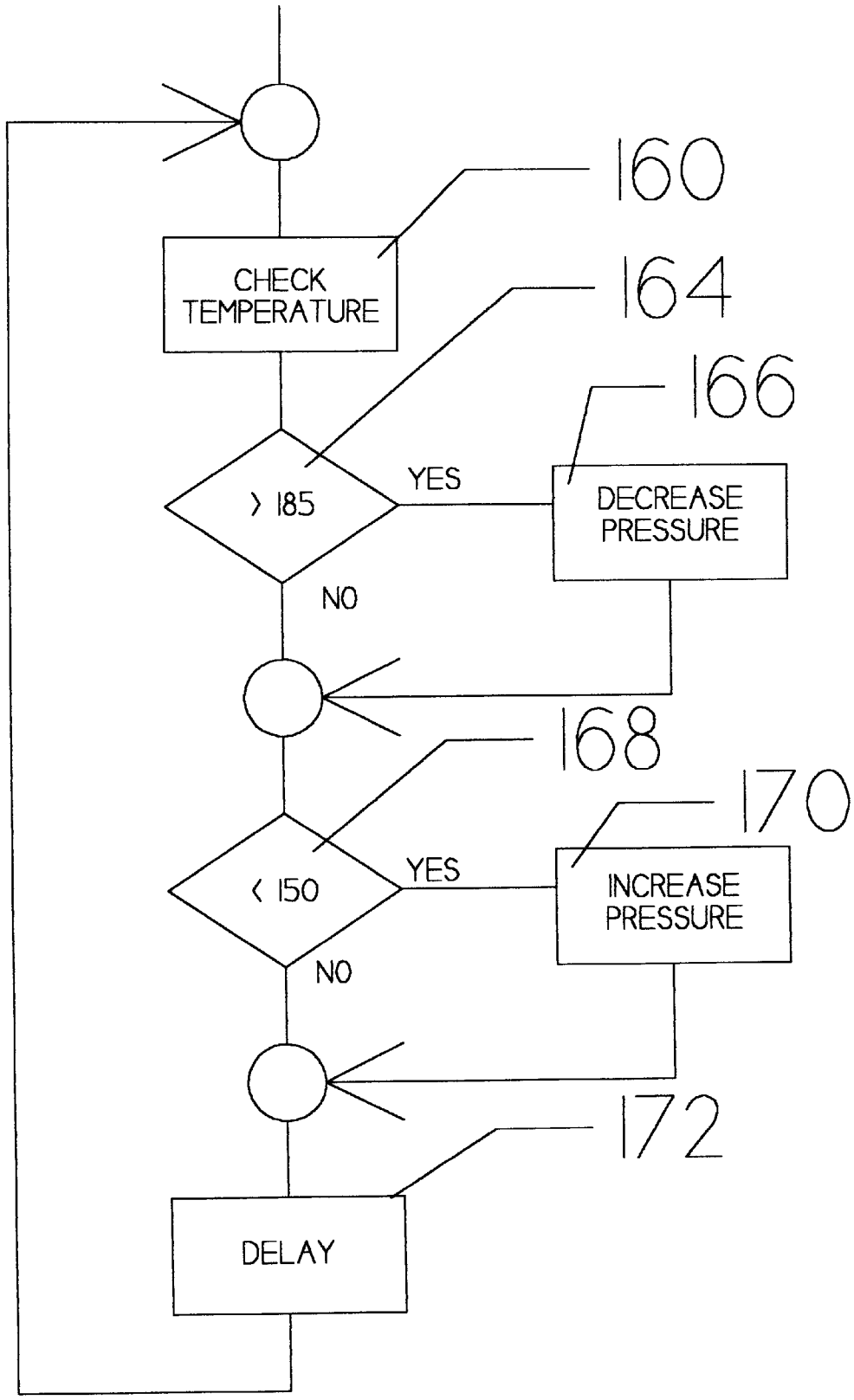
FIG. 5 is a flow diagram showing the temperature regulation algorithm.

FIG. 5 is a flow diagram showing the manner in which the temperature control functions are shown. This logic is intended to operate in a continuous loop. In the preferred mode, the microprocessor is awakened once per second. At that time, the thermopile output voltage is sensed, in addition to the temperature. A detailed description of the output voltage sensing is available in the cross-referenced applications.

The electronic circuit board temperature is sensed at element 160. As explained above, this is accomplished at one second intervals. The value is available from temperature sensor 103 (see also FIG. 3). Element 164 looks for an over temperature condition. The critical temperature is 185 degrees Fahrenheit, as that is the maximum operating temperature for typical electronic circuitry components. It is some times preferable to sense at a slightly lower temperature to provide a safety margin.

If element 164 determines that the temperature is too high, control is given to element 166 to command the stepper motor to incrementally reduce the main valve outlet pressure. Similarly, element 168 determines whether the temperature in an acceptable range. This temperature is much less critical in nature and is chosen at a convenient point, such as 150 degrees Fahrenheit. If the current temperature is acceptable, control is given to element 170 to command the stepper motor to increase the main valve outlet pressure to the desired level commanded by the user.

Element 172 represents the one second delay until the process is repeated at element 160.

Having thus described the preferred embodiments of the present invention, those of skill in the art will be readily able to adapt the teachings found herein to yet other embodiments within the scope of the claims hereto attached.

What is claimed is:

1. In a gas appliance having a flame produced by a main burner wherein said flame of said main burner is controlled by a main valve, the improvement comprising:

a. an electronic circuit coupled to said main valve which controls the pressure of fuel delivery from said main valve; and b. a temperature sensor responsively coupled to said electronic circuit whereby said pressure is reduced if said temperature sensor determines a temperature greater than a first predetermined value.

2. The improvement according to claim 1 wherein said pressure is increased if said temperature sensor determines that said temperature is less than a second predetermined value.

3. The improvement according to claim 2 wherein said electronic circuit further comprises a microprocessor.

4. The improvement according to claim 3 further comprising an electronic circuit board wherein said temperature sensor is coupled to said circuit board.

5. The improvement according to claim 4 wherein said first predetermined temperature is selected to protect components on said circuit board.

6. An apparatus comprising:

a. A gas inlet;

b. A gas outlet;

c. A valve having a variable fuel outlet pressure interposed between said gas inlet and said gas outlet;

d. A temperature sensor, and e. An electrical device responsively coupled to said temperature sensor and said valve which controllably varies said pressure from a first non-zero value to a second non-zero value in response to temperature sensed by said temperature sensor.

7. An apparatus according to claim 6 wherein said electrical device further comprises a microprocessor.

8. An apparatus according to claim 7 further comprising a stepper motor responsively coupled to said microprocessor which controls said pressure.

9. An apparatus according to claim 8 wherein said pressure is reduced if said temperature sensor measures a temperature greater than a first predetermined value.

10. An apparatus according to claim 9 wherein said pressure is increased if said temperature sensor measures a temperature less than a second predetermined value.

11. A method of facilitating protecting electronic circuitry from overheating within a gas appliance having a valve with an adjustable fuel pressure comprising:

a. periodically measuring the temperature at a circuit board containing said electronic circuitry;

b. decreasing said pressure if said temperature exceeds a first predetermined value; and c. increasing said pressure if said temperature exceeds a second predetermined value.

12. A method according to claim 11 wherein said decreasing step and said increasing step further comprise a stepper motor varying pressure at said valve.

13. A method according to claim 12 wherein the period of step a is approximately one second.

14. A method according to claim 13 wherein said measuring step is accomplished by a temperature sensor.

15. A method according to claim 14 wherein the position of said stepper motor is determined by a microprocessor.

16. An apparatus comprising:

a. Means for supplying a gaseous fuel;

b. Means for determining temperature; and c. Means responsively coupled to said supplying means and said determining means for electrically changing said flow is response to temperature sensed by said determining means.

17. An apparatus according to claim 16 wherein said electrically changing means increases said pressure if said temperature is determined to be less than a first predetermined value.

18. An apparatus according to claim 17 wherein said electronically changing means further comprises a microprocessor.

19. An apparatus according to claim 18 wherein said electronically changing means further comprises a stepper motor.

20. An apparatus according to claim 19 wherein said determining means further comprises a temperature sensor.

* * * * *